United States Patent [19]

Reedy

[11] Patent Number: 4,758,181

[45] Date of Patent: Jul. 19, 1988

[54] LOCKING ARRANGEMENT FOR A LAMP SOCKET ASSEMBLY

[75] Inventor: Patrick J. Reedy, Youngstown, Ohio

[73] Assignee: General Motors Corporation, Detroit, Mich.

[21] Appl. No.: 78,287

[22] Filed: Jul. 27, 1987

[51] Int. Cl.[4] ..... H01R 13/74

[52] U.S. Cl. ..... 439/546; 439/333; 439/336; 439/602

[58] Field of Search ..... 439/318, 332–337, 439/546, 549, 552–558, 602, 321

[56] References Cited

U.S. PATENT DOCUMENTS

| | | | |
|---|---|---|---|
| 2,890,434 | 6/1959 | Ray et al. | 439/321 |
| 4,029,953 | 6/1977 | Natoli | 439/546 |
| 4,059,324 | 11/1977 | Snyder et al. | 439/321 |
| 4,285,564 | 8/1981 | Spinner | 439/321 |
| 4,373,771 | 2/1983 | Cross et al. | 438/549 |
| 4,477,864 | 10/1984 | Van Duyn et al. | 362/311 |

OTHER PUBLICATIONS

Part No. Print 12020348.

*Primary Examiner*—John McQuade
*Attorney, Agent, or Firm*—Edward J. Biskup

[57] ABSTRACT

A lamp socket and housing combination in which a J-slot bayonet type connection is provided for maintaining the lamp socket within the housing and cooperating lock means are formed on the lamp socket and the housing for preventing the lamp socket from being released from the housing due to reverse rotation of the lamp socket.

3 Claims, 1 Drawing Sheet

LOCKING ARRANGEMENT FOR A LAMP SOCKET ASSEMBLY

This invention concerns lamp sockets in general and more particularly relates to a locking arrangement for a lamp socket assembly that is axially insertable into a housing and is maintained therein through a bayonet type connection.

More specifically the present invention pertains to a locking arrangement for a lamp socket and housing wherein the lamp socket includes a cylindrical body portion formed with a pair of diametrically opposed lugs and wherein the housing includes a cylindrical wall defining a cylindrical opening and formed with a pair of diametrically opposed J-shaped slots for receiving the lugs. The body portion of the lamp socket is also formed with an arc shaped spring arm which is located in a plane extending transversely to the body portion and has a diameter greater than the cylindrical opening in the housing so that the end portion of the cylindrical wall is contacted thereby when the lugs of the lamp socket are located in the J-shaped slots of the housing. In addition, lock means project axially outwardly from the spring are and from the end portion of the cylindrical wall and cooperate after the insertion of the lugs into the J-slots and after rotation of the body portion relative to the housing to prevent the body portion from reverse rotation after its insertion into the housing.

The objects of the present invention are to provide a new and improved locking arrangement for a lamp socket having a pair of lugs which are received within J-slots formed in a housing in a manner so as to prevent reverse rotation of the lamp socket after the lugs are positioned within the J-slots; to provide a new and improved lamp socket and housing combination in which a J-slot bayonet type connection is provided for maintaining the lamp socket within the housing and cooperating lock means are formed on the lamp sockets and the housing to prevent the lamp socket from being released from the housing; and to provide a new and improved lamp socket member and housing member combination in which the two members interconnect through a lug and J-slot arrangement and are maintained in a locked condition by a pair of cooperating projections formed on the lamp socket member and the housing member.

Other objects and advantages of the present invention will be apparent from the following description when taken with the drawings in which.

Figure 1:
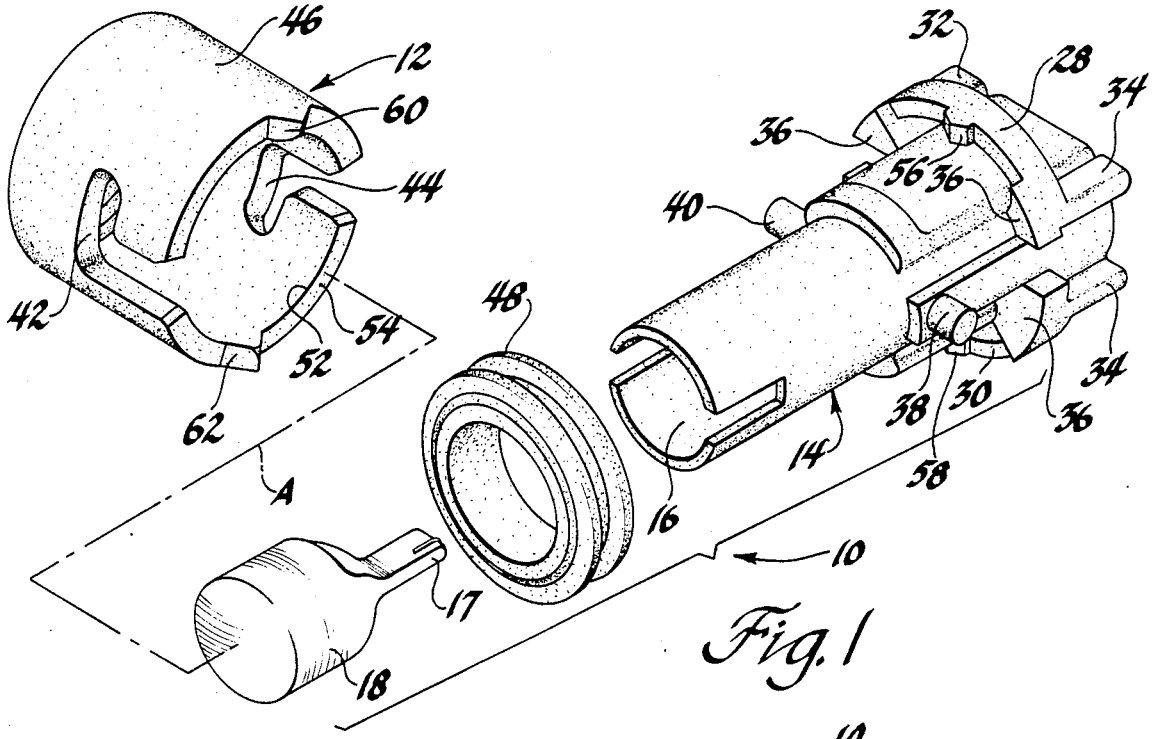
FIG. 1 is an exploded perspective view showing the lamp socket and housing combination made according to the present invention.
Figure 2:
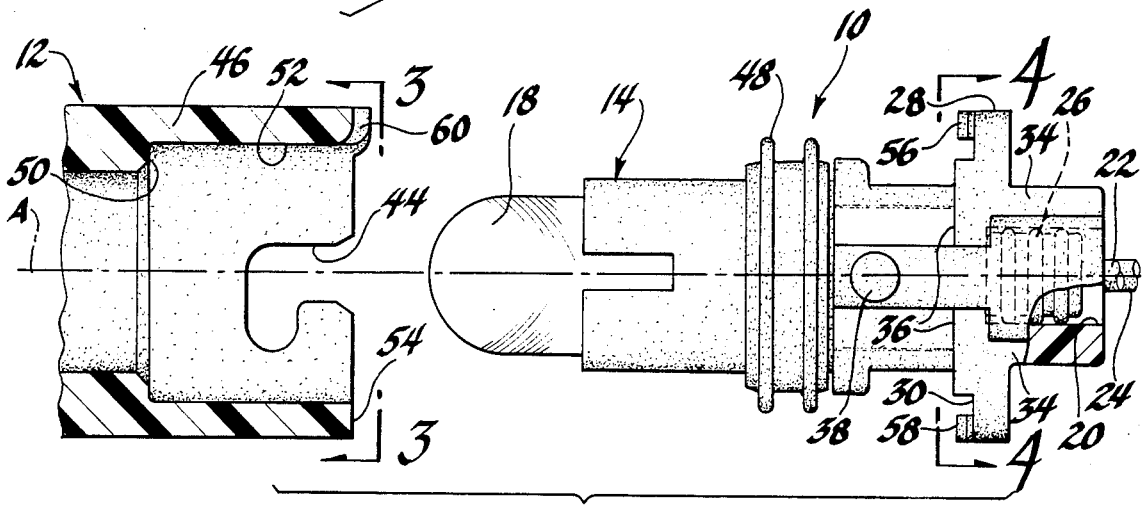
FIG. 2 is a side elevational view of the lamp socket and housing shown in FIG. 1.

Referring to the drawings and more particularly FIGS. 1 and 2 thereof, a lamp socket 10 and accommodating housing 12 is shown made according to the present invention that can form a part of a lamp assembly such as shown in U.S. Pat. No. 4,477,864 which issued on Oct. 16, 1984 in the name of Van Duyn et al and is assigned to the assignee of this invention. In such lamp assembly the housing 12 would constitute the open end of the body portion of the lamp assembly shown in the aforementioned patent and to which the lamp socket 10 is insertable.

More specifically, the lamp socket 10 includes a cylindrical socket member 14 formed of a hard plastic material and has the usual terminals (not shown) located within its open end 16 that grips the base 17 of a wedge base type bulb 18 and provides electrical contact with the lead wires of the bulb 18. The other end of the socket member 14 has a bore 20 formed therein through which extand a pair of electrical cables 22 and 24 which are sealed to the socket member 14 by a multiple cable seal 26. As is conventional the electrical cables 22 and 24 are connected to the terminals in the socket member 14 for providing electrical current for energizing the bulb 18.

Figure 4:
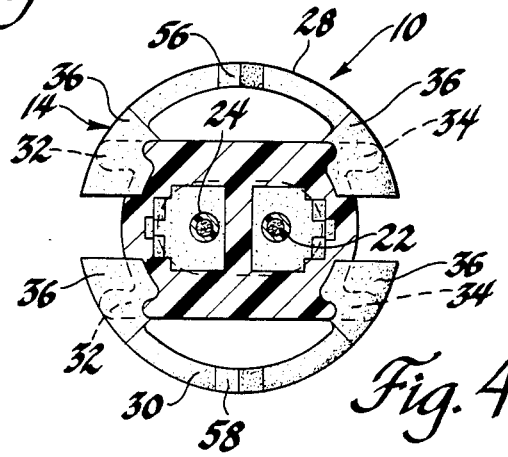
FIG. 4 is a sectional view taken on line 4—4 of FIG. 2.

As seen in FIG. 4, the socket member 14 is formed with a pair of identical arc shaped spring arms 28 and 30 each of which is integral at its opposite ends with longitudinally extending ribs 32 and 34 which likewise are an integral part of the socket member 14. As seen in FIG. 2, each of the ribs 32 and 34 has a flat face 36 located in a common plane which is perpendicular to the longitudinal center axis of the socket member 14. A pair of identical diametrically opposed cylindrical lugs 38 and 40 are also integrally formed with the socket member 14 and the lugs 38 and 40 form one part of a bayonet type connection the other part of which are a pair of identical, but reversed in direction, diametrically opposed J-slots 42 and 44 formed in the cylindrical wall 46 of the housing 12. Forwardly of the lugs 38 and 40, a sealing ring 48 is provided which is positioned adjacent a shoulder 50 in the housing 12 and to seal the socket member 14 with the cylindrical opening 52 once the socket member is mated to the housing 12.

Figure 3:
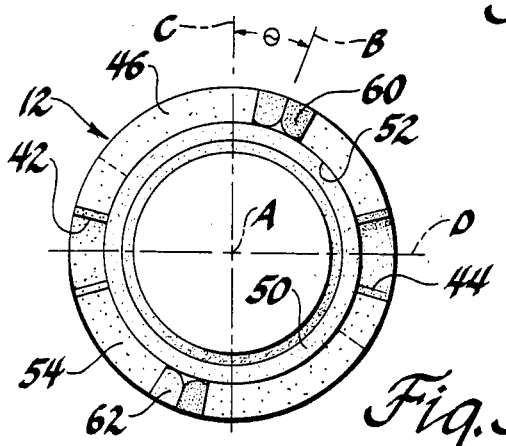
FIG. 3 is a view taken on line 3—3 of FIG. 2 showing the end portion of the housing.

Thus, from the above description it should be apparent that when the socket member 14 is inserted axially into the cylindrical opening in the housing along the axis A as seen in FIGS. 1 and 2, the lugs 38 and 40 enter the open ends of the J-slots 42 and 44 until contact is made between the faces 36 of the ribs 32 and 34 with the end portion 54 of the cylindrical wall 46 that is located in a plane perpendicular to the longitudinal center axis of the housing 12. When this occurs a pair of identical and diametrically opposed lock tabs 56 and 58 integrally formed with the spring arms 28 and 30, respectively, will also make contact with the end portion 54 of the housing 12. As seen in FIG. 4, each of the lock tabs 56 and 58 is located along a vertical axis which passes through the center of the socket member 14 and is perpendicular to an axis extanding through the longitudinal center axes of the lugs 38 and 40. Each lock tab 56 and 58 is formed with a pair of inclined ramp portions which intersect to define a straight edge located in the aforementioned common plane in which the faces 36 of the ribs 32 and 34 are located. Similarly and as seen in FIG. 3, the end portion 54 of the housing 12 is formed with a pair of identical and diametrically opposed lock tabs 60 and 62 each of which is formed with a pair of inclined ramp portions which intersect to define a straight edge located along an axis B which passes through the center of the housing 12 as seen in FIG. 3. In this case, however, the axis B is offset by an angle $\phi$ which is approximately 20° from the vertical axis C which is perpendicular to an axis D which passes through the center of the entrance passages of the J-slots 42 and 44.

The lock tabs 60 and 62 have an axial dimension which is equal to the axial dimension of the lock tabs 56 and 58 on the spring arms 28 and 30. As a result, when the lugs 38 and 40 of the socket member 14 enter the entrance passages of the J-slots 42 and 44 and the faces 36 of the ribs 32 and 34 contact the end portion 54 of the housing 12, the lock tabs 56 and 58 and the lock tabs 60 and 62 will be side by side. The socket member 14 will then be rotated in a clockwise direction causing the lugs 38 and 40 to move into the closed end of the J-slots 32 and 44. At the same time, the lock tabs 56 and 58 will have the lead ramp portions thereof engage the associated ramp portions of the lock tabs 60 and 62 and, as the clockwise rotation of the socket member 14 continues, the spring arms 28 and 30 will flex rearwardly allowing the lock tabs 56 and 58 to move from alignment with the vertical axis C in FIG. 3 to a locked position wherein the lock tab 56 is located to the right of the upper lock tab 60 and the lock tab 58 is located to the left of the lower lock tab 62 as seen in FIG. 3. In this locked condition, the socket member 14 is prevented from rotation in a counterclockwise direction to release the socket member 14 from the housing 12 unless it is forcibly rotated manually.

Thus, the usual vibration experienced by a vehicle will not cause the socket member 14 to move to a released position relative to the housing 12.

Various changes and modifications can be made in this construction without departing from the spirit of the invention. Such changes and modification are contemplated by the inventor and he does not wish to be limited except by the scope of the appended claims.

The embodiments of the invention in which an exclusive property or privilege is claimed are defined as follows:

1. A locking arrangement for a lamp socket and housing wherein said lamp socket includes a cylindrical body portion formed with a pair of diametrically opposed lugs and wherein said housing includes a cylindrical wall defining a cylindrical opening and formed with a pair of diametrically opposed J-slots for receiving said lugs, spring arms means attached to said body portion to the rear of said lugs and located in a plane transverse to said body portion and on a circle having a diameter greater than said cylindrical opening in said housing, and lock means projecting axially outwardly from said spring arm means and from said end portion of said cylindrical wall and cooperating after the insertion of said lugs into said J-slots and rotation of said body portion relative to said housing for preventing said body portion from rotating back to its inserted position.

2. A locking arrangement for a lamp socket and housing wherein said lamp socket includes a cylindrical body portion formed with a pair of diametrically opposed lugs and wherein said housing includes a cylindrical wall defining a cylindrical opening and formed with a pair of diametrically opposed J-slots for receiving said lugs, a pair of spring arms attached to said body portion to the rear of said lugs and being integrally formed with contact faces located in a plane transverse to said body portion and on a circle having a diameter greater than said cylindrical opening in said housing for engaging the end portion of said cylindrical wall when said lugs of said lamp socket are located in said J-slots, and lock means projecting axially outwardly from each of said spring arms and from said end portion of said cylindrical wall and cooperating after the insertion of said lugs into said J-slots and rotation of said body portion relative to said housing for preventing said body portion from rotating back to its inserted position.

3. A locking arrangement for a lamp socket and housing wherein said lamp socket includes a cylindrical body portion formed with a pair of diametrically opposed lugs and wherein said housing includes a cylindrical wall defining a cylindrical opening and formed with a pair of diametrically opposed J-slots for receiving said lugs, a pair of arc shaped spring arms attached to said body portion to the rear of said lugs and being integrally formed with contact faces located in a plane transverse to said body portion and on a circle having a diameter greater than said cylindrical opening in said housing for engaging the end portion of said cylindrical wall when said lugs of said lamp socket are located in said J-slots, and each of said spring arms having a lock tab projecting axially outwardly therefrom and formed with a pair of ramps which intersect at a straight edge located along an axis which passes through the center of said socket members and is perpendicular to the longitudinal center axis of said lugs, a pair of lock tabs projecting axially outwardly from said end portion of said cylindrical wall of said housing and cooperating with the lock tabs of said spring arms after the insertion of said lugs into said slots and rotation of said body portion relative to said housing for preventing said body portion from rotating back to its inserted position.

* * * * *